US007687212B2

(12) United States Patent
Wu

(10) Patent No.: US 7,687,212 B2
(45) **Date of Patent: *Mar. 30, 2010**

(54) CHARGE TRAPPING RELEASER CONTAINING PHOTOGENERATING LAYER PHOTOCONDUCTORS

(75) Inventor: Jin Wu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 357 days.

This patent is subject to a terminal disclaimer.

(21) Appl. No.: 11/869,279

(22) Filed: Oct. 9, 2007

(65) Prior Publication Data

US 2009/0092909 A1 Apr. 9, 2009

(51) Int. Cl.
*G03G 5/047* (2006.01)

(52) U.S. Cl. ..... 430/58.05; 430/58.5; 430/58.35; 430/58.75

(58) Field of Classification Search ..... 430/58.75, 430/58.05, 58.35
See application file for complete search history.

(56) References Cited

U.S. PATENT DOCUMENTS

| | | | | |
|---|---|---|---|---|
| 4,265,990 | A | 5/1981 | Stolka et al. | |
| 4,301,226 | A * | 11/1981 | Contois et al. | 430/72 |
| 4,464,450 | A | 8/1984 | Teuscher | |
| 4,587,189 | A | 5/1986 | Hor et al. | |
| 4,921,773 | A | 5/1990 | Melnyk et al. | |
| 5,473,064 | A | 12/1995 | Mayo et al. | |
| 5,482,811 | A | 1/1996 | Keoshkerian et al. | |
| 5,521,306 | A | 5/1996 | Burt et al. | |
| 6,913,863 | B2 | 7/2005 | Wu et al. | |
| 7,037,631 | B2 | 5/2006 | Wu et al. | |
| 2009/0005555 | A1 * | 1/2009 | Wu | 540/145 |

OTHER PUBLICATIONS

Jin Wu et al., U.S. Appl. No. (not yet assigned) on Additive Containing Photogenerating Layer Photoconductors, filed concurrently herewith.
Jin Wu et al., U.S. Appl. No. (not yet assigned) on Phosphonium Containing Photogenerating Layer Photoconductors, filed concurrently herewith.
Jin Wu et al., U.S. Appl. No. (not yet assigned) on Additive Containing Charge Transport Layer Photoconductors, filed concurrently herewith.
Jin Wu et al., U.S. Appl. No. (not yet assigned) on Imidazolium Salt Containing Charge Transport Layer Photoconductors, filed concurrently herewith.
Jin Wu et al., U.S. Appl. No. (not yet assigned) on Phosphonium Containing Charge Transport Layer Photoconductors, filed concurrently herewith.
Jin Wu et al., U.S. Appl. No. (not yet assigned) on Charge Trapping Releaser Containing Charge Transport Layer Photoconductors, filed concurrently herewith.
Jin Wu et al., U.S. Appl. No. (not yet assigned) on Salt Additive Containing Photoconductors, filed concurrently herewith.
Liang-Bih Lin et al., U.S. Appl. No. 11/800,108 on Photoconductors, filed May 4, 2007.
Liang-Bih Lin et al., U.S. Appl. No. 11/800,129 on Photoconductors, filed May 4, 2007.

* cited by examiner

*Primary Examiner*—John L Goodrow
(74) *Attorney, Agent, or Firm*—E. D. Palazzo

(57) ABSTRACT

A photoconductor that includes for example, a supporting substrate, a photogenerating layer, and at least one charge transport layer comprised of at least one charge transport component, and where the photogenerating layer contains at least one charge trapping releaser.

19 Claims, No Drawings

CHARGE TRAPPING RELEASER CONTAINING PHOTOGENERATING LAYER PHOTOCONDUCTORS

CROSS REFERENCE TO RELATED APPLICATIONS

U.S. application Ser. No. 11/869,231, U.S. Publication 20090092913, filed Oct. 9, 2007, entitled Additive Containing Photogenerating Layer Photoconductors by Jin Wu et al., the disclosure of which is totally incorporated herein by reference, illustrates a photoconductor comprising a supporting substrate, a photogenerating layer, and at least one charge transport layer comprised of at least one charge transport component, and wherein the photogenerating layer contains at least one of an ammonium salt and an imidazolium salt.

U.S. application Ser. No. 11/869,246, U.S. Publication 20090092914, filed Oct. 9, 2007, entitled Phosphonium Containing Photogenerating Layer Photoconductors by Jin Wu et al., the disclosure of which is totally incorporated herein by reference, illustrates a photoconductor comprising a supporting substrate, a phosphonium salt containing photogenerating layer, and at least one charge transport layer comprised of at least one charge transport component.

U.S. application Ser. No. 11/869,252, U.S. Publication 20090092911, filed Oct. 9, 2007, entitled Additive Containing Charge Transport Layer Photoconductors by Jin Wu et al., the disclosure of which is totally incorporated herein by reference, illustrates a photoconductor comprising a supporting substrate, a photogenerating layer, and at least one charge transport layer comprised of at least one charge transport component, and wherein the charge transport layer contains at least one ammonium salt.

U.S. application Ser. No. 11/869,258. U.S. Publication 20090092912, filed Oct. 9, 2007, entitled Imidazolium Salt Containing Charge Transport Layer Photoconductors by Jin Wu et al., the disclosure of which is totally incorporated herein by reference, illustrates a photoconductor comprising a supporting substrate, a photogenerating layer, and at least one charge transport layer comprised of at least one charge transport component, and wherein at least one charge transport layer contains at least one imidazolium salt.

U.S. application Ser. No. 11/869,265, U.S. Publication 20090092915, filed Oct. 9, 2007, entitled Phosphonium Containing Charge Transport Layer Photoconductors by Jin Wu et al., the disclosure of which is totally incorporated herein by reference, there is disclosed a photoconductor comprising a supporting substrate, a photogenerating layer, and at least one charge transport layer comprised of at least one charge transport component, and wherein the at least one charge transport layer contains at least one phosphonium salt.

U.S. application Ser. No. 11/869,269, U.S. Publication 20090092908, filed Oct. 9, 2007, entitled Charge Trapping Releaser Containing Photogenerating Layer Photoconductors by Jin Wu, the disclosure of which is totally incorporated herein by reference, there is disclosed a photoconductor comprising a supporting substrate, a photogenerating layer, and at least one charge transport layer comprised of at least one charge transport component, and wherein the photogenerating layer contains at least one charge trapping releaser component.

U.S. application Ser. No. 11/869,284, U.S. Publication 20090092910, filed Oct. 9, 2007, entitled Salt Additive Containing Photoconductors by Jin Wu, the disclosure of which is totally incorporated herein by reference, illustrates a photoconductor comprising a supporting substrate, a photogenerating layer, and at least one charge transport layer comprised of at least one charge transport component, and wherein at least one of the photogenerating layer and the charge transport layer contains at least one of a pyridinium salt and a tetrazolium salt.

In U.S. application Ser. No. 11/800,129, U.S. Publication 20080274419, entitled Photoconductors, filed May 4, 2007 by Liang-Bih Lin et al., the disclosure of which is totally incorporated herein by reference, there is illustrated a photoconductor comprising a supporting substrate, a photogenerating layer, and at least one charge transport layer comprised of at least one charge transport component, and wherein the photogenerating layer contains a bis(pyridyl)alkylene.

In U.S. application Ser. No. 11/800,108, U.S. Publication 20080274418, entitled Photoconductors, filed May 4, 2007 by Jin Wu et al., the disclosure of which is totally incorporated herein by reference, there is disclosed a photoconductor comprising a supporting substrate, a photogenerating layer, and at least one charge transport layer comprised of at least one charge transport component, and wherein the charge transport layer contains a benzoimidazole.

BACKGROUND

This disclosure is generally directed to imaging members, photoreceptors, photoconductors, and the like. More specifically, the present disclosure is directed to multilayered drum, or flexible, belt imaging members, or devices comprised of a supporting medium like a substrate, a photogenerating layer, and a charge transport layer, including a plurality of charge transport layers, such as a first charge transport layer and a second charge transport layer, and wherein the photogenerating layer contains an additive or dopant, and a photoconductor comprised of a supporting medium like a substrate, a photogenerating layer, and a charge transport layer, including a plurality of charge transport layers, such as a first charge transport layer and a second charge transport layer, and wherein at least one of the charge transport layers contains an additive or dopant.

The additives or dopants which can be incorporated into the photogenerating layer, and which dopants function, for example, to passivate the photogenerating pigment surface by, for example, blocking or substantially blocking intrinsic free carriers, and preventing or minimizing external free carriers from attracting to the pigment surface, and thereby permitting photoconductors with minimal CDS (charge deficient spots), the control of PIDC, for example controlling, and more specifically, reducing the PIDC, especially in those situations where the photosensitivity of the photoconductor can be adjusted on line and automatically, to a desired preselected value or amount, and which photosensitivity can be increased or decreased; and acceptable LCM characteristics, such as for example, improved lateral charge migration (LCM) resistance.

Also included within the scope of the present disclosure are methods of imaging and printing with the photoconductor devices illustrated herein. These methods generally involve the formation of an electrostatic latent image on the imaging member, followed by developing the image with a toner composition comprised, for example, of thermoplastic resin, colorant such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, the imaging members and flexible belts disclosed herein can be selected for the Xerox Corporation iGEN3® machines that generate with some versions over 100 copies per minute. Processes of imaging, especially xerographic imaging and printing, including digital, and/or color printing are thus encompassed by the present disclosure.

The photoconductors disclosed herein are in embodiments sensitive in the wavelength region of, for example, from about 400 to about 900 nanometers, and in particular from about 650 to about 850 nanometers, thus diode lasers can be selected as the light source. Moreover, the imaging members disclosed herein are in embodiments useful in high resolution color xerographic applications, particularly high-speed color copying and printing processes.

REFERENCES

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoconductors have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer.

In U.S. Pat. No. 4,587,189, the disclosure of which is totally incorporated herein by reference, there is illustrated a layered imaging member with, for example, a perylene, pigment photogenerating component and an aryl amine component, such as N,N'-diphenyl-N,N'-bis(3-methylphenyl)-1,1'-biphenyl-4,4'-diamine dispersed in a polycarbonate binder as a hole transport layer.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises as a first step hydrolyzing a gallium phthalocyanine precursor pigment by dissolving the hydroxygallium phthalocyanine in a strong acid, and then reprecipitating the resulting dissolved pigment in basic aqueous media.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and more specifically, about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and more specifically, about 24 hours.

The appropriate components, such as the supporting substrates, the photogenerating layer components, the charge transport layer components, the overcoating layer components, and the like of the above-recited patents, may be selected for the photoconductors of the present disclosure in embodiments thereof.

SUMMARY

Disclosed are imaging members and photoconductors that contain a dopant in the photogenerating layer or charge transport layer, and where there are permitted preselected electrical characteristics, and more specifically, acceptable PIDC values; excellent charge deficient spot (CDS) characteristics, excellent lateral charge migration (LCM) resistance, and excellent cyclic stability properties.

Additionally disclosed are flexible belt imaging members containing optional hole blocking layers comprised of, for example, amino silanes, (throughout in this disclosure plural also includes nonplural, thus there can be selected a single amino silane), metal oxides, phenolic resins, and optional phenolic compounds, and which phenolic compounds contain at least two, and more specifically, two to ten phenol groups or phenolic resins with, for example, a weight average molecular weight ranging from about 500 to about 3,000, permitting, for example, a hole blocking layer with excellent efficient electron transport which usually results in a desirable photoconductor low residual potential $V_{low}$.

The photoconductors illustrated herein, in embodiments, have excellent wear resistance, extended lifetimes, elimination or minimization of imaging member scratches on the surface layer or layers of the member, and which scratches can result in undesirable print failures where, for example, the scratches are visible on the final prints generated. Additionally, in embodiments the photoconductors disclosed herein possess excellent, and in a number of instances low $V_r$ (residual potential), and allow the substantial prevention of $V_r$ cycle up when appropriate for at least about 40,000 xerographic imaging cycles; low acceptable image ghosting characteristics; low background; and/or minimal charge deficient spots (CDS). At least one in embodiments refers, for example, to one, to from 1 to about 10, to from 2 to about 7; to from 2 to about 4, 2, and the like.

EMBODIMENTS

In embodiments, there is disclosed a photoconductor comprising a supporting substrate, a photogenerating layer, and at least one charge transport layer comprised of at least one charge transport component, and wherein the photogenerating layer contains at least one charge trapping releaser; a photoconductor comprised in sequence of an optional supporting substrate, a photogenerating layer, and a charge transport layer; and wherein the photogenerating layer contains a charge trapping haloacetate releaser component present in an amount of from about 0.05 to about 15 weight percent; a photoconductor comprising a supporting substrate, a photogenerating layer, a first hole transport layer, and a second hole transport layer; and wherein the photogenerating layer has incorporated therein a charge trapping releaser component; a photoconductor comprised of a supporting medium like a substrate, a photogenerating layer, and a charge transport layer, including a plurality of charge transport layers, such as a first charge transport layer and a second charge transport layer, and wherein the first charge transport layer in contact with the photogenerating layer contains a charge trapping releaser component to thereby control, reduce, or minimize charge trapping and light shock; and a photoconductor comprised of a supporting medium like a substrate, a photogenerating layer, and a charge transport layer, and wherein the charge transport layer contains a charge trapping releaser; a photoconductor comprising a supporting substrate, a photogenerating layer, and at least one charge transport layer comprised of at least one charge transport component, and wherein the at least one charge transport layer contains at least one charge trapping haloacetate releaser; a photoconductor comprised in sequence of an optional supporting substrate, a photogenerating layer, and a charge transport layer, and wherein the charge transport layer contains a charge trapping releaser component present in an amount of from about 0.05 to about 5 weight percent; and a photoconductor comprising a supporting substrate, a photogenerating layer, a first hole transport layer, and a second hole transport layer; and wherein the first hole transport layer has incorporated therein a charge trapping releaser component. Additionally, in embodiments the releaser can be incorporated solely into the photogenerating layer and where the charge transport layer is substantially free or free of the releaser component.

Aspects of the present disclosure relate to a photoconductor comprising a supporting substrate, a photogenerating layer, and at least one charge transport layer comprised of at least one charge transport component, and where the photogenerating layer, or charge transport layer contains the additive or dopant as illustrated herein; a photoconductor comprising a supporting substrate, a photogenerating layer, and at least one charge transport layer comprised of at least one charge transport component, and wherein the photogenerating layer contains at least one of an ammonium salt and an imidazolium salt; a photoconductor comprised in sequence of an optional supporting substrate, a photogenerating layer, and a charge transport layer, and wherein the photogenerating layer contains an ammonium salt; a photoconductor comprising a supporting substrate, a photogenerating layer, and a hole transport layer, and wherein the photogenerating layer is comprised of a photogenerating pigment and present in various suitable amounts at least one of tetrabutylammonium fluoride, benzalkonium chloride, (2-methoxyethoxymethyl) triethylammonium chloride, dodecyltrimethylammonium chloride, hexamethonium chloride dihydrate, stachydrine hydrochloride, trimethyl[3-(triethoxysilyl)propyl]ammonium chloride, (ferrocenylmethyl)dodecyldimethyl ammonium bromide, choline bromide, decamethonium bromide, n-octyltrimethylammonium bromide, (ferrocenylmethyl)trimethylammonium iodide, 1,1-dimethyl-4-phenylpiperazinium iodide, tetra-n-hexylammonium iodide, hexadecyltrimethylammonium hydroxide, tris(2-hydroxyethyl) methylammonium hydroxide, benzyltrimethylammonium hydroxide, 1-butyl-1-methylpyrrolidinium bis(trifluoromethanesulfonyl)imide, bis(tetra-n-butylammonium) tetracyanodiphenoquinodimethanide, choline bitartrate, dodecyldimethyl(3-sulfopropyl)ammonium hydroxide inner salt, hexadecyltrimethylammonium hexafluorophosphate, N-fluoro-N'-(chloromethyl)triethylenediamine bis(tetrafluoroborate), n-hexadecyltrimethylammonium tetrafluoroborate, tetra-n-butylammonium dichloroaurate, tetra-n-butylammonium difluorotriphenylsilicate, tetra-n-butylammonium difluorotriphenylstannate, tetra-n-butylammonium tetraphenylborate, N,N'-(isopropyl) imidazolium chloride, imidazolium triflate, N,N'-(adamantyl)imidazolium tetrafluoroborate, 1,3-bis(2,4,6-trimethylphenyl)imidazolium chloride, 1-methyl-3-(3-cyanopropyl)imidazolium dicyanamide, N,N'-bis-(tert-butyl)imidazolium tetrafluoroborate, 1-[bis(4-chlorophenyl) methyl]-3-[2,4-dichloro-β-(2,4-dichlorobenzyloxy) phenethyl]imidazolium chloride, 1-butyl-3-(2-pyridinylmethyl)-1H-imidazolium hexafluorophosphate, 4-(3-butyl-1-imidazolio)-1-butanesulfonic acid triflate, 1-methyl-3-(cyanomethyl)imidazolium chloride, 1,3-dimethylimidazolium dimethyl phosphate, 1-butyl-3-methylimidazolium bis(trifluoromethanesulfonyl)imide, 1-butyl-3-methylimidazolium tetrachloroferrate, 1-ethyl-3-methylimidazolium 2-(2-methoxyethoxy)ethyl sulfate, 1-methyl-3-propylimidazolium iodide, and 1,3-di-tertiary-butylimidazolium tetrafluoroborate; a photoconductor wherein the ammonium salt is at least one of tetrabutylammonium fluoride, benzalkonium chloride, (2-methoxyethoxymethyl)triethylammonium chloride, dodecyltrimethylammonium chloride, hexamethonium chloride dihydrate, stachydrine hydrochloride, trimethyl[3-(triethoxysilyl)propyl]ammonium chloride, (ferrocenylmethyl)dodecyldimethyl ammonium bromide, choline bromide, decamethonium bromide, n-octyltrimethylammonium bromide, (ferrocenylmethyl)trimethylammonium iodide, 1,1-dimethyl-4-phenylpiperazinium iodide, tetra-n-hexylammonium iodide, hexadecyltrimethylammonium hydroxide, tris(2-hydroxyethyl)methylammonium hydroxide, benzyltrimethylammonium hydroxide, 1-butyl-1-methylpyrrolidinium bis(trifluoromethanesulfonyl)imide, bis(tetra-n-butylammonium) tetracyano diphenoquinodimethanide, choline bitartrate, dodecyldimethyl(3-sulfopropyl)ammonium hydroxide inner salt, hexadecyltrimethylammonium hexafluorophosphate, N-fluoro-N'-(chloromethyl)triethylenediamine bis(tetrafluoroborate), n-hexadecyltrimethyl ammonium tetrafluoroborate, tetra-n-butylammonium dichloroaurate, tetra-n-butylammonium difluorotriphenylsilicate, tetra-n-butylammonium difluorotriphenylstannate, and tetra-n-butylammonium tetraphenylborate optionally present in an amount of from about 15 parts per million to about 750 parts per million; a photoconductor wherein the imidazolium salt is at least one of 1,3-di-tertiary-butylimidazolium tetrafluoroborate, N,N'-(isopropyl)imidazolium chloride, imidazolium triflate, N,N'-(adamantyl)imidazolium tetrafluoroborate, 1,3-bis(2,4,6-trimethylphenyl)imidazolium chloride, 1-methyl-3-(3-cyanapropyl)imidazolium dicyanamide, N,N'-bis-(tert-butyl)imidazolium tetrafluoroborate, 1-[bis(4-chlorophenyl)methyl]-3-[2,4-dichloro-β-(2,4-dichlorobenzyloxy)phenethyl]imidazolium chloride, 1-butyl-3-(2-pyridinylmethyl)-1H-imidazolium hexafluorophosphate, 4-(3-butyl-1-imidazolio)-1-butanesulfonic acid triflate, 1-methyl-3-(cyanomethyl)imidazolium chloride, 1,3-dimethylimidazolium dimethyl phosphate, 1-butyl-3-methylimidazolium bis(trifluoromethanesulfonyl)imide, 1-butyl-3-methylimidazolium tetrachloroferrate, 1-ethyl-3-methylimidazolium 2-(2-methoxyethoxy)ethyl sulfate, and 1-methyl-3-propylimidazolium iodide optionally present in an amount of from about 20 parts per million to 1,000 parts per million, and mixtures thereof; a photoconductor wherein the charge transport component is an aryl amine selected from the group consisting of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, and mixtures thereof; and wherein the at least one charge transport layer is from 1 to about 4, and wherein the salt is tetrabutylammonium fluoride, benzalkonium chloride, (2-methoxyethoxymethyl) triethylammonium chloride, dodecyltrimethylammonium chloride, hexamethonium chloride dihydrate, stachydrine hydrochloride, trimethyl[3-(triethoxysilyl)propyl]ammonium chloride, (ferrocenylmethyl)dodecyl dimethylammonium bromide, choline bromide, decamethonium bromide, n-octyltrimethylammonium bromide, (ferrocenylmethyl)trimethylammonium iodide, 1,1-dimethyl-4-phenylpiperazinium iodide, tetra-n-hexylammonium iodide, hexadecyltrimethylammonium hydroxide, tris(2-hydroxyethyl) methylammonium hydroxide, benzyltrimethylammonium hydroxide, 1-butyl-1-methylpyrrolidinium bis(trifluoromethanesulfonyl)imide, bis(tetra-n-butylammonium)tetracyano diphenoquinodimethanide, choline bitartrate, dodecyldimethyl(3-sulfopropyl) ammonium hydroxide inner salt, hexadecyltrimethylammonium hexafluorophosphate, N-fluoro-N'-(chloromethyl)triethylenediamine bis(tetrafluoroborate), n-hexadecyl trimethylammonium tetrafluoroborate, tetra-n-butylammonium dichloroaurate, tetra-n-butylammonium difluorotriphenylsilicate, tetra-n-butylammonium difluorotriphenylstannate, tetra-n-butylammonium tetraphenylborate, N,N'-isopropyl) imidazolium chloride, imidazolium triflate, N,N'-(adamantyl)imidazolium tetrafluoroborate, 1,3-bis(2,4,6-trimethylphenyl)imidazolium chloride, 1-methyl-3-(3-cyanopropyl)imidazolium dicyanamide, N,N'-bis-(tert-butyl)imidazolium tetrafluoroborate, 1-[bis(4-chlorophenyl) methyl]-3-[2,4-dichloro-β-(2,4-dichlorobenzyloxy) phenethyl]imidazolium chloride, 1-butyl-3-(2-pyridinylmethyl)-1H-imidazolium hexafluorophosphate, 4-(3-butyl-1-imidazolio)-1-butanesulfonic acid triflate, 1-methyl-3-(cyanomethyl)imidazolium chloride, 1,3-dimethylimidazolium dimethyl phosphate, 1-butyl-3-methylimidazolium bis(trifluoromethanesulfonyl)imide, 1-butyl-3-methylimidazolium tetrachloroferrate, 1-ethyl-3-methylimidazolium 2-(2-methoxyethoxy)ethyl sulfate, 1-methyl-3-propylimidazolium iodide, 1,3-di-tertiary-butylimidazolium tetrafluoroborate; a photoconductor wherein the photogenerating pigment is a hydroxygallium phthalocyanine, a titanyl phthalocyanine, or a halogallium phthalocyanine; a photoconductor wherein at least one charge transport layer is comprised of a first charge transport layer, and a second charge transport layer and wherein the additive is included in each layer in an amount of from about 10 to about 125 parts per million; a photoconductor wherein the substrate is comprised of a conductive material, and wherein the additive or dopant is tetrabutylammonium fluoride, benzalkonium chloride, (2-methoxyethoxymethyl) triethylammonium chloride, dodecyltrimethylammonium chloride, hexamethonium chloride dihydrate, stachydrine hydrochloride, trimethyl[3-(triethoxysilyl)propyl] ammonium chloride, (ferrocenylmethyl)dodecyl dimethylammonium bromide, choline bromide, decamethonium bromide, n-octyltrimethylammonium bromide, (ferrocenylmethyl)trimethylammonium iodide, 1,1-dimethyl-4-phenylpiperazinium iodide, tetra-n-hexylammonium iodide, hexadecyltrimethylammonium hydroxide, tris(2-hydroxyethyl)methylammonium hydroxide, benzyltrimethylammonium hydroxide, 1-butyl-1-methylpyrrolidinium bis(trifluoromethanesulfonyl)imide, bis(tetra-n-butylammonium) tetracyanodiphenoquinodimethanide, choline bitartrate, dodecyldimethyl(3-sulfopropyl)ammonium hydroxide inner salt, hexadecyltrimethylammonium hexafluorophosphate, N-fluoro-N'-(chloromethyl) triethylenediamine bis(tetrafluoroborate), n-hexadecyltrimethylammonium tetrafluoroborate, tetra-n-butylammonium dichloroaurate, tetra-n-butylammonium difluorotriphenylsilicate, tetra-n-butylammonium difluorotriphenylstannate, tetra-n-butylammonium tetraphenylborate, N,N'-(isopropyl)imidazolium chloride, imidazolium triflate, N,N'-(adamantyl)imidazolium tetrafluoroborate, 1,3-bis(2,4,6-trimethylphenyl)imidazolium chloride, 1-methyl-3-(3-cyanopropyl)imidazolium dicyanamide, N,N'-bis-(tert-butyl) imidazolium tetrafluoroborate, 1-[bis(4-chlorophenyl) methyl]-3-[2,4-dichloro-β-(2,4-dichlorobenzyloxy) phenethyl]imidazolium chloride, 1-butyl-3-(2-pyridinylmethyl)-1H-imidazolium hexafluorophosphate, 4-(3-butyl-1-imidazolio)-1-butanesulfonic acid triflate, 1-methyl-3-(cyanomethyl) imidazolium chloride, 1,3-dimethylimidazolium dimethyl phosphate, 1-butyl-3-methylimidazolium bis(trifluoromethanesulfonyl)imide, 1-butyl-3-methylimidazolium tetrachloroferrate, 1-ethyl-3-methylimidazolium 2-(2-methoxyethoxy)ethyl sulfate, 1-methyl-3-propylimidazolium iodide, or 1,3-di-tertiary-butylimidazolium tetrafluoroborate; and which additive is present in an amount of from about 20 to about 800 parts per million; a flexible photoconductive imaging member comprised in sequence of a supporting substrate, an additive containing photogenerating layer thereover, a charge transport layer, and a protective top overcoating layer; a photoconductor which includes a hole blocking layer and an adhesive layer where the adhesive layer is situated between the hole blocking layer and the photogenerating layer, and the hole blocking layer is situated between the substrate and the adhesive layer; and a photoconductor wherein the additive or dopant can be selected in various effective amounts, such as for example, in parts per million, like from about 1 to about 1,000, and from about 10 to about 500 parts per million of the additive.

ADDITIVE/DOPANT EXAMPLES

Examples of charge trapping releasers incorporated into the charge transport layer, into the photogenerating layer, or both the charge transport layer and the photogenerating layer include a haloacetate like trifluoroacetate. Haloacetate charge trapping releasers can be formed by an acid-base neutralization reaction where the acid is, for example, a haloacetic acid such as a monofluoroacetic acid, a monochloroacetic acid, a monobromoacetic acid, a monoiodoacetic acid, a dichloroacetic acid, a trichloroacetic acid, a trifluoroacetic acid, mixtures thereof, and the like; the base is, for example, ammonia, an amine, a pyridine, an aniline, an imidazole, mixtures thereof, and the like; and the mole ratio of the acid and the base is, for example, about 1:1, from about 1:1 to about 1:5, or from about 5:1 to about 1:2.

Specific examples of haloacetates include a number of trifluoroacetate charge trapping releasers such as pyridinium trifluoroacetate (pyridine trifluoroacetate), ammonium trifluoroacetate, tetraethylammonium trifluoroacetate, triethylamine trifluoroacetate, 4-dimethylamino-1-trifluoroacetylpyridinium trifluoroacetate, Rhodamine 6G-N-(2-aminoethyl)amide bis(trifluoroacetate), Rhodamine 6G-N-(6-aminohexyl)amide bis(trifluoroacetate), imidazole trifluoroacetate, N-methylaniline trifluoroacetate, and the like, and mixtures thereof.

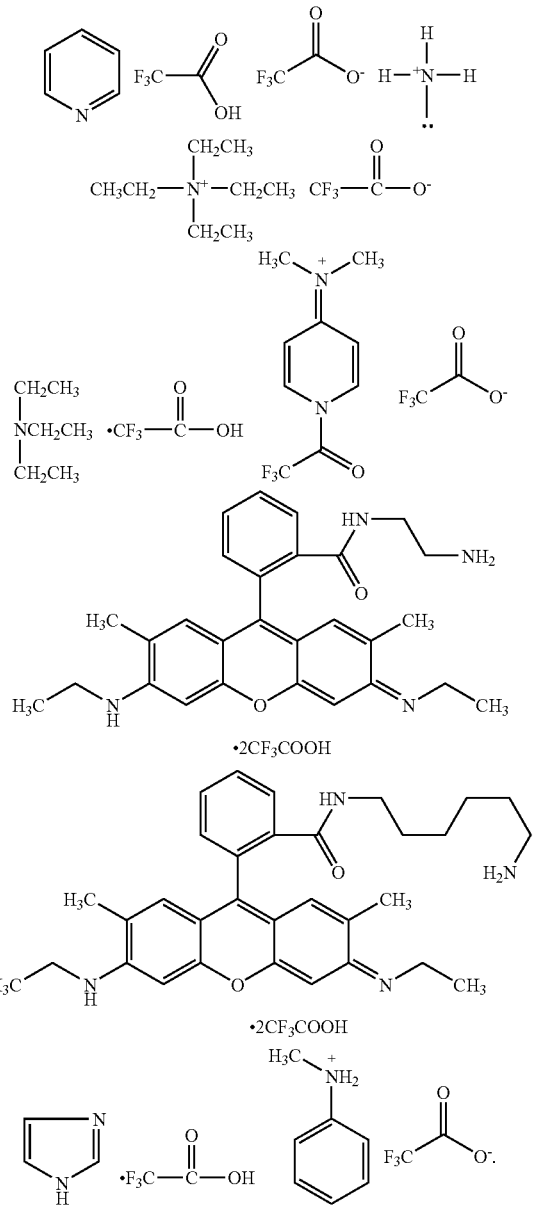

Specific examples of charge trapping releasers that can be selected for the charge transport layer, the photogenerating layer, or both the charge transport layer and photogenerating layer include thallium haloacetates, phosphonium haloacetates, iodonium haloacetates, sulfonium haloacetates, oxonium haloacetates, and tretazolium haloacetates. Specific examples include diethylthallium trifluoroacetate, 2,6-bis-(4-methoxy-phenyl)-4-phenyl-pyranylium trifluoroacetate, tetraethylphosphonium trifluoroacetate, 4-isopropyl-4'-methyl-diphenyliodonium trifluoroacetate, tri-p-tolylsulfonium trifluoroacetate, 2,3,5-triphenyltetrazolium trifluoroacetate, and the like, and mixtures thereof present in various suitable amounts.

These and other similar releasers can be present in the charge transport layer, or the photogenerating layer in various suitable amounts, such as from about 0.001 to about 20, from about 0.01 to about 10, from about 0.1 to about 7, from about 2 to about 5 weight percent, based on the charge transport layer components of the charge transport compound, resin binder, optional known additives, and the releaser; or based on the photogenerating components of at least one photogenerating pigment, a resin binder, and the releaser.

Examples of charge trapping releasers incorporated into, added to, or mixed within the charge transport layer, the photogenerating layer, or both the charge transport layer and the photogenerating layer, and where the charge transport layer or layers include an aryl amine, such as a first and second charge transport, include a haloacetate like a trihaloacetate. Haloacetates can be formed by, for example, acid-base neutralization reactions wherein the acid is a haloacetic acid, such as monofluoroacetic acid, monochloroacetic acid, monobromoacetic acid, monoiodoacetic acid, dichloroacetic acid, trichloroacetic acid, and trifluoroacetic acid; the base is ammonia, an amine, a pyridine, an aniline, or an imidazole; and the mole ratio of the acid and the base is about 1:1, or more generally, from about 1:1 to about 1:5, or from about 1:1 to about 5:1. Specific examples of haloacetates include trifluoroacetates, and more specifically, pyridinium trifluoroacetate (pyridine trifluoroacetate), ammonium trifluoroacetate, tetraethylammonium trifluoroacetate, triethylamine trifluoroacetate, 4-dimethylamino-1-trifluoroacetylpyridinium trifluoroacetate, Rhodamine 6G-N-(2-aminoethyl)amide bis(trifluoroacetate), Rhodamine 6G-N-(6-aminohexyl)amide bis(trifluoroacetate), imidazole trifluoroacetate, N-methylaniline trifluoroacetate, and the like, and mixtures thereof. Specific examples of the charge trapping releaser can be represented, for example, by the following

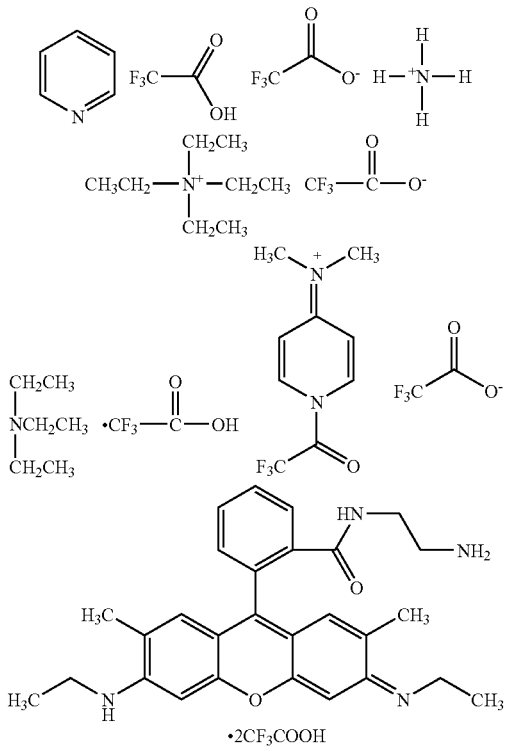

-continued

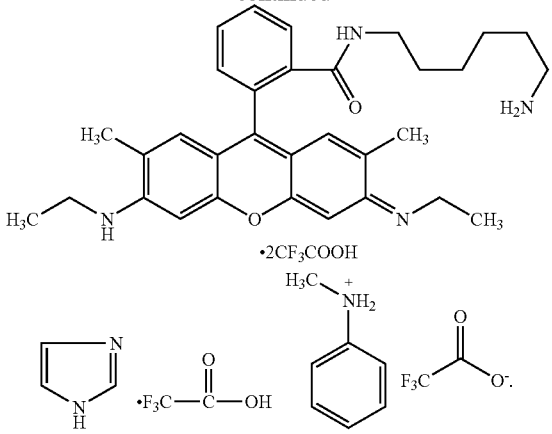

Quaternary ammonium cation examples include positively charged polyatomic ions of the formula $NR_4^+$ with R being alkyl group, which alkyl can be the same or dissimilar, and which alkyl groups can be connected. Unlike the ammonium ion $NH_4^+$ itself and a number of primary, secondary, or tertiary ammonium cations, the quaternary ammonium cations are permanently charged, independent of the pH of the solution thereof. Quaternary ammonium salts or quaternary ammonium compounds that can be selected as a dopant can be referred to as salts of quaternary ammonium cations with an anion.

Typical ammonium salts include ammonium fluorides, ammonium chlorides, ammonium bromides, ammonium iodides, ammonium hydroxides, and ammonium salts with other anions.

Examples of ammonium fluorides include tetrabutylammonium fluoride represented as follows, and the like

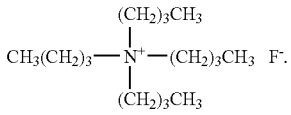

Examples of ammonium chlorides include benzalkonium chloride, (2-methoxyethoxymethyl)triethylammonium chloride, dodecyltrimethylammonium chloride, hexamethonium chloride dihydrate, stachydrine hydrochloride, trimethyl[3-(triethoxysilyl)propyl]ammonium chloride, represented as follows, and the like

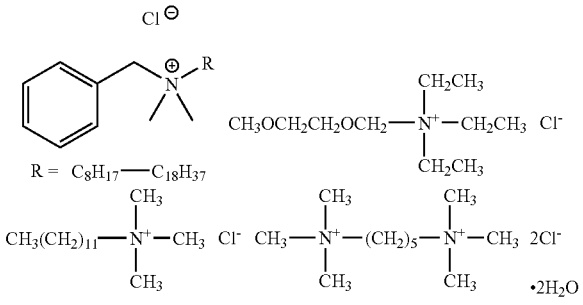

-continued

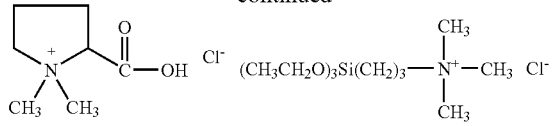

Examples of ammonium bromides include (ferrocenylmethyl) dodecyldimethylammonium bromide, choline bromide, decamethonium bromide, n-octyltrimethylammonium, bromide, represented as follows, and the like

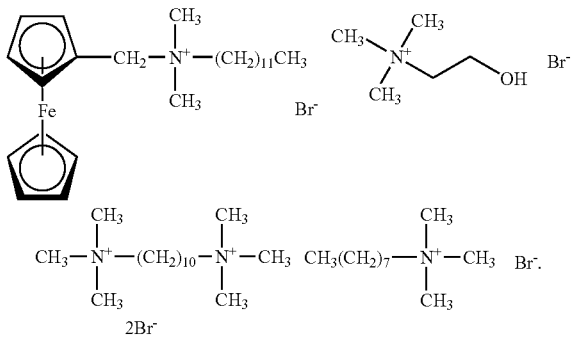

Examples of ammonium iodides include (ferrocenylmethyl) trimethylammonium iodide, 1,1-dimethyl-4-phenylpiperazinium iodide, tetra-n-hexylammonium iodide, represented as follows, and the like

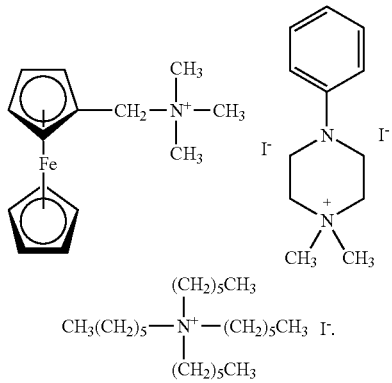

Examples of ammonium hydroxides include hexadecyltrimethylammonium hydroxide, tris(2-hydroxyethyl)methylammonium hydroxide, benzyltrimethylammonium hydroxide, represented as follows, and the like

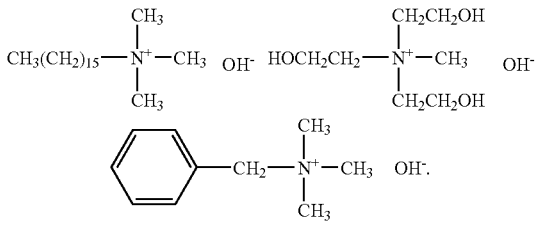

Examples of ammonium salts are 1-butyl-1-methylpyrrolidinium bis(trifluoromethanesulfonyl)imide, bis(tetra-n-butylammonium) tetracyanodiphenoquinodimethanide, choline bitartrate, dodecyldimethyl(3-sulfopropyl)ammonium hydroxide inner salt, hexadecyltrimethylammonium hexafluorophosphate, N-fluoro-N'-(chloromethyl)triethylenediamine bis(tetrafluoroborate), n-hexadecyltrimethylammonium tetrafluoroborate, tetra-n-butylammonium dichloroaurate, tetra-n-butylammonium difluorotriphenylsilicate, tetra-n-butylammonium difluorotriphenylstannate, tetra-n-butylammonium tetraphenylborate, represented as follows, and the like

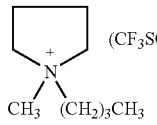

Liquid

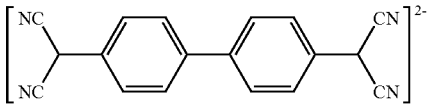

$2[(n\text{-}C_4H_8)_4N]^+$

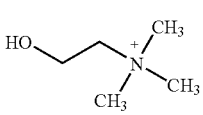

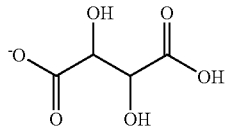

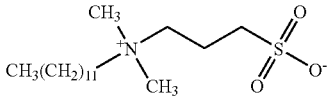

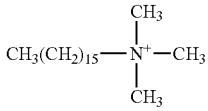

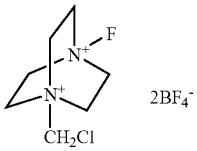

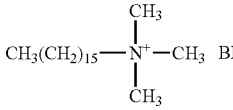

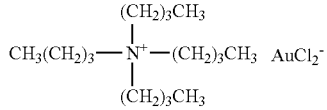

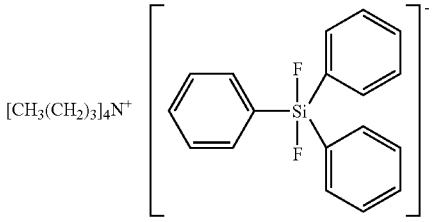

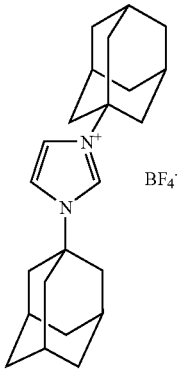

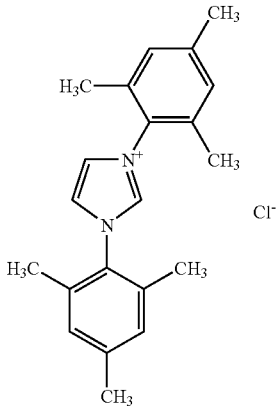

-continued

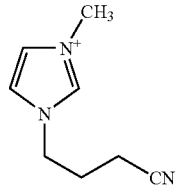

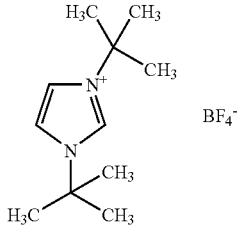

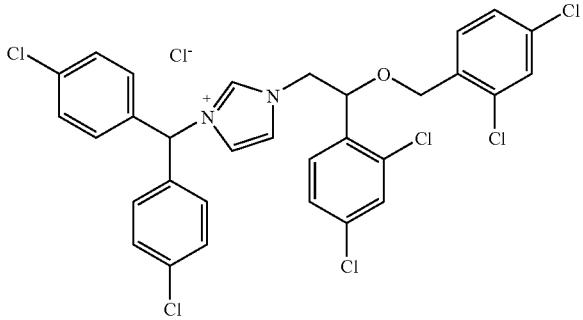

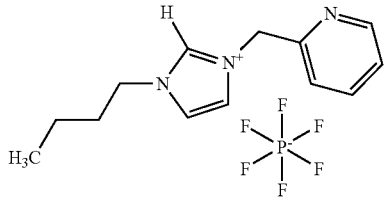

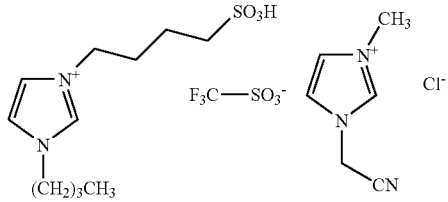

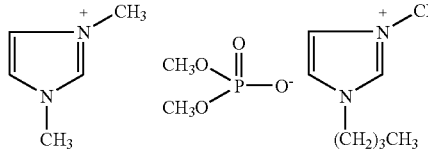

Liquid Liquid

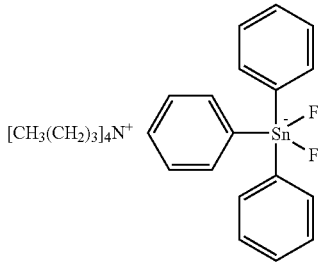

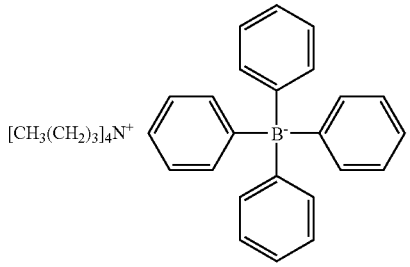

Imidazolium salt examples that can be selected as the dopant include 1,3-di-tertiary-butylimidazolium tetrafluoroborate, N,N'-(isopropyl)imidazolium chloride, imidazolium triflate, N,N'-(adamantyl)imidazolium tetrafluoroborate, 1,3-bis(2,4,6-trimethylphenyl)imidazolium chloride, 1-methyl-3-(3-cyanopropyl)imidazolium dicyanamide, 1-[bis(4-chlorophenyl)methyl]-3-[2,4-dichloro-β-(2,4-dichlorobenzyloxy)phenethyl]imidazolium chloride, 1-butyl-3-(2-pyridinylmethyl)-1H-imidazolium hexafluorophosphate, 4-(3-butyl-1-imidazolio)-1-butanesulfonic acid triflate, 1-methyl-3-(cyanomethyl)imidazolium chloride, 1,3-dimethylimidazolium dimethyl phosphate, 1-butyl-3-methylimidazolium bis(trifluoromethanesulfonyl)imide, 1-butyl-3-methylimidazolium tetrachloroferrate, 1-ethyl-3-methylimidazolium 2-(2-methoxyethoxy)ethyl sulfate, 1-methyl-3-propylimidazolium iodide, represented as follows, and the like

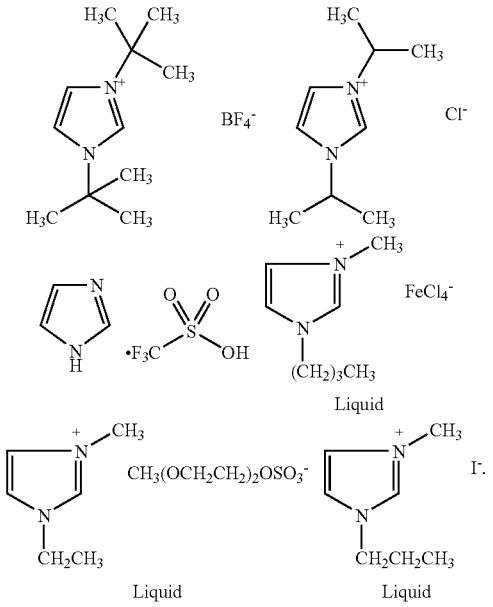

Photoconductive Layer Components

The thickness of the photoconductor substrate layer depends on various factors, including economical considerations, desired electrical characteristics, adequate flexibility, and the like, thus this layer may be of substantial thickness, for example over 3,000 microns, such as from about 1,000 to about 2,000 microns, from about 500 to about 1,000 microns, or from about 300 to about 700 microns ("about" throughout includes all values in between the values recited), or of a minimum thickness. In embodiments, the thickness of this layer is from about 75 microns to about 300 microns, or from about 100 to about 150 microns. In embodiments, the photoconductor can be free of a substrate, for example the layer usually in contact with the substrate can be increased in thickness. For a photoconductor drum, the substrate or supporting medium may be of a substantial thickness of, for example, up to many centimeters or of a minimum thickness of less than a millimeter. Similarly, a flexible belt may be of a substantial thickness of, for example, about 250 micrometers, or of a minimum thickness of less than about 50 micrometers, provided there are no adverse effects on the final electrophotographic device.

Also, the photoconductor may in embodiments include a blocking layer, an adhesive layer, a top overcoating protective layer, and an anticurl backing layer.

The photoconductor substrate may be opaque, substantially opaque, or substantially transparent, and may comprise any suitable material that, for example, permits the photoconductor layers to be supported. Accordingly, the substrate may comprise a number of known layers, and more specifically, the substrate can be comprised of an electrically nonconductive or conductive material such as an inorganic or an organic composition. As electrically nonconducting materials, there may be selected various resins known for this purpose including polyesters, polycarbonates, polyamides, polyurethanes, and the like, which are flexible as thin webs. An electrically conducting substrate may comprise any suitable metal of, for example, aluminum, nickel, steel, copper, and the like, or a polymeric material filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like.

In embodiments where the substrate layer is to be rendered conductive, the surface thereof may be rendered electrically conductive by an electrically conductive coating. The conductive coating may vary in thickness depending upon the optical transparency, degree of flexibility desired, and economic factors, and in embodiments this layer can be of a thickness of from about 0.05 micron to about 5 microns.

Illustrative examples of substrates are as illustrated herein, and more specifically, supporting substrate layers selected for the photoconductors of the present disclosure comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

Generally, the photogenerating layer can contain known photogenerating pigments, such as metal phthalocyanines, metal free phthalocyanines, and more specifically alkylhydroxyl gallium phthalocyanines, hydroxygallium phthalocyanines, chlorogallium phthalocyanines, perylenes, especially bis(benzimidazo)perylene, titanyl phthalocyanines, and the like, and yet more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume.

In embodiments, the photogenerating component or pigment is present in a resinous binder in various amounts, inclusive of 100 percent by weight based on the weight of the photogenerating components that are present. Generally, however, from about 5 percent by volume to about 95 percent by volume of the photogenerating pigment is dispersed in about 95 percent by volume to about 5 percent by volume of the resinous binder, or from about 20 percent by volume to about 30 percent by volume of the photogenerating pigment is dispersed in about 70 percent by volume to about 80 percent by volume of the resinous binder composition. In one embodiment, about 90 percent by volume of the photogenerating pigment is dispersed in about 10 percent by volume of the resinous binder composition, and which resin may be selected from a number of known polymers, such as poly (vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

In embodiments, examples of polymeric binder materials that can be selected as the matrix for the photogenerating layer components are known and include thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene, and acrylonitrile copolymers, poly(vinyl chloride), vinyl chloride and vinyl acetate copolymers, acrylate copolymers, alkyd resins, cellulosic film formers, poly (amideimide), styrenebutadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The dopant in embodiments can be added to the photogenerating dispersion or to the charge transport mixture, and such dopant is, more specifically, substantially dissolved in the photogenerating dispersion solvent or in the charge transport layer mixture. Moreover, the dopant or additive can be included in both the photogenerating layer, and in the charge transport layer or layers.

The final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 30, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer or interfacial layer and the photogenerating layer. Usually, the photogenerating layer is applied onto the blocking layer and a charge transport layer or plurality of charge transport layers are formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As an optional adhesive layer usually in contact with or situated between the hole blocking layer and the photogenerating layer, there can be selected various known substances inclusive of copolyesters, polyamides, poly(vinyl butyral), poly(vinyl alcohol), polyurethane, and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The optional hole blocking or undercoat layers for the imaging members of the present disclosure can contain a number of components including known hole blocking components, such as amino silanes, doped metal oxides, a metal oxide like titanium, chromium, zinc, tin and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The optional hole blocking layer may be applied to the substrate. Any suitable and conventional blocking layer capable of forming an electronic barrier to holes between the adjacent photoconductive layer (or electrophotographic imaging layer) and the underlying conductive surface of substrate may be selected.

A number of charge transport compounds can be included in the charge transport layer, which layer generally is of a thickness of from about 5 microns to about 75 microns, and more specifically, of a thickness of from about 10 microns to about 45 microns. Examples of charge transport components are aryl amines of the following formulas/structures

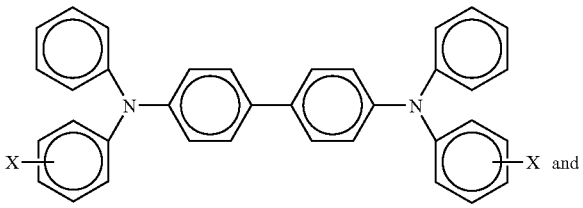

-continued

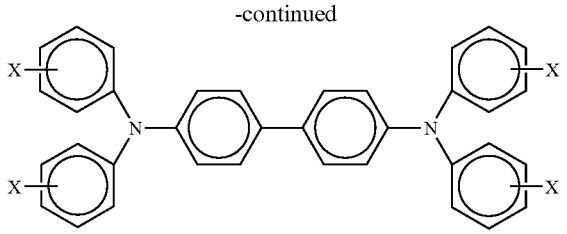

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

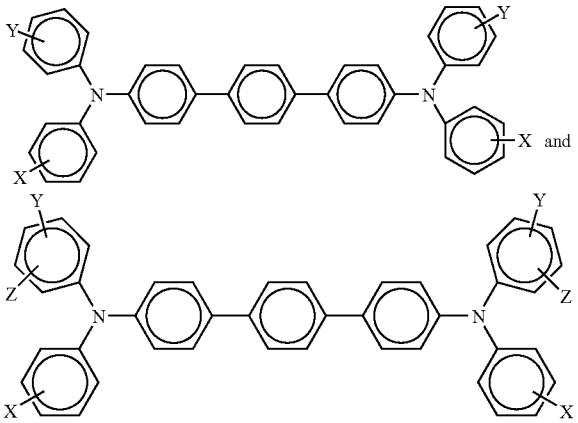

wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine-diphenylene), carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_W$ of from about 50,000 to about 100,000. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules present, for example, in an amount of from about 50 to about 75 weight percent include, for example, pyrazolines such as 1-phenyl-3-(4'-diethylaminostyryl)-5-(4"-diethylaminophenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl) carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency and transports them across the charge transport layer with short transit times includes N,N'-diphenyl-N,N'-bis(3-metyhlphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material or a combination of a small molecule charge transport material and a polymeric charge transport material.

Examples of components or materials optionally incorporated into the charge transport layers or at least one charge transport layer to, for example, enable excellent lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20, from about 1 to about 10, or from about 3 to about 8 weight percent.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is from about 10 to about 70 micrometers, but thicknesses outside this range may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer. Typical application techniques include spraying, dip coating, roll coating, wire wound rod coating, and the like. Drying of the deposited coating may be effected by any suitable conventional technique, such as oven drying, infrared radiation drying, air drying, and the like. An optional overcoating may be applied over the charge transport layer to provide abrasion protection.

The present disclosure in embodiments thereof relate to a photoconductive imaging member comprised of a supporting substrate, an additive containing photogenerating layer, a charge blocking containing charge transport layer, and an overcoating charge transport layer; a photoconductive member with a photogenerating layer of a thickness of from about 0.1 to about 10 microns, and at least one transport layer each of a thickness of from about 5 to about 100 microns; a member wherein the thickness of the photogenerating layer is from about 0.1 to about 4 microns; a member wherein the photogenerating layer contains a polymer binder; a member wherein the binder is present in an amount of from about 50 to about 90 percent by weight, and wherein the total of all layer components is about 100 percent; a member wherein the photogenerating component is a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate, or titanized polyethylene terephthalate; a photoconductor wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating pigment is a metal free phthalocyanine; a photoconductor wherein each of the charge transport layers, especially a first and second charge transport layer, comprises

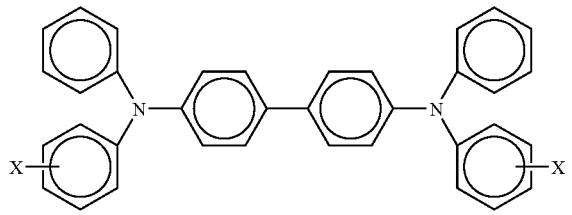

wherein X is selected from the group consisting of lower, that is with, for example, from 1 to about 8 carbon atoms, alkyl, alkoxy, aryl, and halogen; a photoconductor wherein each of, or at least one of the charge transport layers comprises

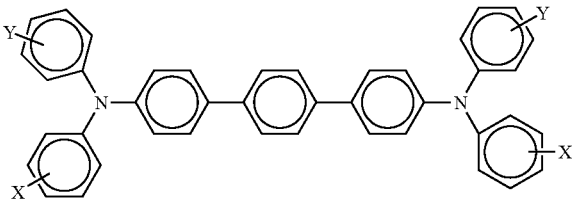

wherein X and Y are independently lower alkyl, lower alkoxy, phenyl, a halogen, or mixtures thereof, and wherein the photogenerating and charge transport layer resinous binder is selected from the group consisting of polycarbonates and polystyrene; a photoconductor wherein the photogenerating pigment present in the photogenerating layer is comprised of chlorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta+/−0.2°) 7.4, 9.8, 12.4, 16.2, 17.6, 18.4, 21.9, 23.9, 25.0, 28.1 degrees, and the highest peak at 7.4 degrees; a method of imaging which comprises generating an electrostatic latent image on the photoconductor developing the latent image, and transferring the developed electrostatic image to a suitable substrate; a method of imaging wherein the imaging member is exposed to light of a wavelength of from about 370 to about 950 nanometers; a member wherein the photogenerating layer is of a thickness of from about 0.1 to about 50 microns; a member wherein the photogenerating pigment is dispersed in from about 1 weight percent to about 80 weight percent of a polymer binder; a member wherein the binder is present in an amount of from about 50 to about 90 percent by weight, and wherein the total of the layer components is about 100 percent; a photoconductor wherein the photogenerating component is Type V hydroxygallium phthalocyanine, or chlorogallium phthalocyanine, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine molecules, and wherein the hole transport resinous binder is selected from the group consisting of polycarbonates and polystyrene; an imaging member wherein the photogenerating layer contains a metal free phthalocyanine; a photoconductive imaging member comprised of a supporting substrate, a doped photogenerating layer, a hole transport layer, and in embodiments wherein a plurality of charge transport layers are selected, such as for example, from two to about ten, and more specifically two, may be selected; and a photoconductive imaging member comprised of an optional supporting substrate, a photogenerating layer, and a first, second, and third charge transport layer.

The following Examples are being submitted to illustrate embodiments of the present disclosure.

Comparative Example 1

A dispersion of a hole blocking layer was prepared by milling 18 grams of $TiO_2$ (MT-150W, manufactured by Tayca Co., Japan), 24 grams of a phenolic resin (VARCUM® 29159, OxyChem Co.) at a solid weight ratio of about 60 to about 40 in a solvent of about 50 to about 50 in weight of xylene and 1-butanol, and a total solid content of about 52 percent in an Attritor mill with about 0.4 to about 0.6 millimeter size $ZrO_2$ beads for 6.5 hours, and then filtering with a 20 μm Nylon filter. To the resulting dispersion was then added methyl isobutyl ketone in a solvent mixture of xylene, 1-butanol at a weight ratio of 47.5:47.5:5 (xylene:butanol:ketone). A 30 millimeter aluminum drum substrate was coated using known coating techniques with the above-formed dispersion. After drying a hole blocking layer of $TiO_2$ in the phenolic resin ($TiO_2$/phenolic resin=60/40), about 10 microns in thickness were obtained.

A photogenerating layer comprising chlorogallium phthalocyanine (Type B) was disposed on the above hole blocking layer or undercoat layer at a thickness of about 0.2 μm. The photogenerating layer coating dispersion was prepared as follows. 2.7 Grams of chlorogallium phthalocyanine (ClGaPc) Type B pigment were mixed with 2.3 grams of polymeric binder (carboxyl-modified vinyl copolymer, VMCH, Dow Chemical Company), 15 grams of n-butyl acetate, and 30 grams of xylene. The mixture was milled in an Attritor mill with about 200 grams of 1 millimeter Hi-Bea borosilicate glass beads for about 3 hours. The dispersion was filtered through a 20 μm Nylon cloth filter, and the solid content of the dispersion was diluted to about 6 weight percent.

Subsequently, a 32 micron charge transport layer was coated on top of the photogenerating layer from a dispersion prepared from N,N'-diphenyl-N,N-bis(3-methylphenyl)-1,1'-biphenyl-4,4'-diamine (5.38 grams), a film forming polymer binder PCZ 400 [poly(4,4'-dihydroxy-diphenyl-1-1-cyclohexane, $M_W$=40,000)], available from Mitsubishi Gas Chemical Company, Ltd. (7.13 grams), and PTFE POLYFLON™ L-2 microparticle (1 gram) available from Daikin Industries dissolved/dispersed in a solvent mixture of 20 grams of tetrahydrofuran (THF), and 6.7 grams of toluene via a CAVIPRO™ 300 nanomizer (Five Star Technology, Cleveland, Ohio). The charge transport layer was dried at about 120° C. for about 40 minutes.

Comparative Example 2

There was prepared a photoconductor with a biaxially oriented polyethylene naphthalate substrate (KALEDEX™ 2000) having a thickness of 3.5 mils, and thereover, a 0.02 micron thick titanium layer was coated on the biaxially oriented polyethylene naphthalate substrate (KALEDEX™ 2000). Subsequently, there was applied thereon, with a gravure applicator or an extrusion coater, a hole blocking layer solution containing 50 grams of 3-aminopropyl triethoxysilane (γ-APS), 41.2 grams of water, 15 grams of acetic acid, 684.8 grams of denatured alcohol, and 200 grams of heptane. This layer was then dried for about 1 minute at 120° C. in a forced air dryer. The resulting hole blocking layer had a dry thickness of 500 Angstroms. An adhesive layer was then deposited by applying a wet coating over the blocking layer, using a gravure applicator or an extrusion coater, and which adhesive contained 0.2 percent by weight based on the total weight of the solution of the copolyester adhesive (ARDEL D100™ available from Toyota Hsutsu Inc.) in a 60:30:10 volume ratio mixture of tetrahydrofuran/monochlorobenzene/methylene chloride. The adhesive layer was then dried for about 1 minute at 120° C. in the forced air dryer of the coater. The resulting adhesive layer had a dry thickness of 200 Angstroms.

A photogenerating layer dispersion was prepared by introducing 0.45 gram of the known polycarbonate IUPILON 200™ (PCZ-200) weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V) and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the hydroxygallium phthalocyanine dispersion. This slurry was then placed on a shaker for 10 minutes. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the ground strip layer. The photogenerating layer was dried at 120° C. for 1 minute in a forced air oven to form a dry photogenerating layer having a thickness of 0.4 micron.

The resulting photoconductor web was then coated with a dual charge transport layer. The first charge transport layer was prepared by introducing into an amber glass bottle in a weight ratio of 50/50, N,N'-bis(methylphenyl)-1,1-biphenyl-4,4'-diamine (TBD) and poly(4,4'-isopropylidene diphenyl) carbonate, a known bisphenol A polycarbonate having a $M_W$ molecular weight average of about 120,000, commercially available from Farbenfabriken Bayer A.G. as MAKROLON® 5705. The resulting mixture was then dissolved in methylene chloride to form a solution containing 15.6 percent by weight solids. This solution was applied on the photogenerating layer to form the charge transport layer coating that upon drying (120° C. for 1 minute) had a thickness of 16.5 microns. During this coating process, the humidity was equal to or less than 30 percent, for example 25 percent.

The above first pass charge transport layer (CTL) was then overcoated with a second top charge transport layer in a second pass. The charge transport layer solution of the top layer was prepared introducing into an amber glass bottle in a weight ratio of 35/65, N,N'-bis(methylphenyl)-1,1-biphenyl-4,4'-diamine (TBD) and poly(4,4'-isopropylidene diphenyl) carbonate, a known bisphenol A polycarbonate having a $M_W$ molecular weight average of about 120,000, commercially available from Farbenfabriken Bayer A.G. as MAKROLON® 5705. The resulting mixture was then dissolved in methylene chloride to form a solution containing 15.6 percent by weight solids. This solution was applied, using a 2 mil Bird bar, on the bottom layer of the charge transport layer to form a coating that upon drying (120° C. for 1 minute) had a thickness of 16.5 microns. During this coating process, the humidity was equal to or less than 15 percent. The total two-layer CTL thickness was 33 microns.

Example I

A photoconductor was prepared by repeating the process of Comparative Example 1 except that there was included in the photogenerating layer 5 percent by weight of the additive pyridinium trifluoroacetate; the photogenerating layer dispersion was allowed to mix for at least 8 hours, that is about 10 hours, before coating this layer on the substrate, and more specifically, on the adhesive layer.

Example II

A photoconductor is prepared by repeating the process of Comparative Example 1 except that there is included in the photogenerating layer 2 percent by weight of the additive ammonium trifluoroacetate.

Example III

A photoconductor is prepared by repeating the process of Example I except that there is included in the photogenerating layer 10 percent by weight of the additive imidazole trifluoroacetate.

Example IV

A photoconductor is prepared by repeating the process of Comparative Example 2 except that there is included in the photogenerating layer 5 percent by weight of the additive diethylthallium trifluoroacetate, and the photogenerating layer dispersion is allowed to mix for at least 8 hours before the coating thereof on the adhesive layer.

Example V

A photoconductor is prepared by repeating the process of Comparative Example 2 except that there is included in the photogenerating layer 15 percent by weight of the additive 2,6-bis-(4-methoxy-phenyl)-4-phenyl-pyranylium trifluoroacetate.

Electrical Property Testing

The above prepared photoconductors of Comparative Example 1 and Example I were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The devices were tested at surface potentials of 700 volts with the exposure light intensity incrementally increased by means of regulating a series of neutral density filters; and the exposure light source was a 780 nanometer light emitting diode. The xerographic simulation was completed in an environmentally controlled light tight chamber at ambient conditions (40 percent relative humidity and 22° C.).

The photoconductors of Comparative Example 1 and Example I exhibited substantially identical PIDCs. Incorporation of the trifluoroacetate charge trapping releaser into the photogenerating layer did not adversely affect the electrical properties of the photoconductor.

Light Shock Reduction

An in-house light shock test was performed for the above-prepared photoconductor devices of Comparative Example 1 and Example I. The top half of (50 percent) of each of the above-prepared photoconductors were exposed under office light for 120 minutes, and the PIDCs were measured immediately after light exposure. As comparison, the bottom half of the photoconductors were shielded by black paper during the above office light exposure, and the PIDCs of the bottom halves were also measured. The light shock results are summarized in Table 1.

TABLE 1

| | V (2.8 ergs/cm$^2$) of the Shielded Bottom Half (V) | V (2.8 ergs/cm$^2$) of the Exposed Top Half (V) |
|---|---|---|
| Comparative Example 1 | 311 | 248 |
| Example I | 296 | 259 |

V(2.8 ergs/cm$^2$) is the surface potential of the photoconductor when the exposure was 2.8 ergs/cm$^2$, and this was used to characterize the photoconductor. When the photoconductor drums were exposed to a white light, V(2.8 ergs/cm$^2$) was reduced immediately after exposure.

The disclosed photoconductor device (Example I) exhibited 37V (volts) decrease in V(2.8 ergs/cm$^2$), whereas the controlled photoconductor device of Comparative Example 1 exhibited 63V (volts) decrease in V(2.8 ergs/cm$^2$) immediately after office light exposure, which indicated that the Example I photoconductor device was more light shock resistant with less of a drop in V(2.8 ergs/cm$^2$).

Thus, incorporation of the charge trapping releaser in the photogenerating layer improved light shock resistance with a V(2.8 ergs/cm$^2$) drop about one half of that of the Comparative Example 1 control photoconductor device without the charge trapping releaser in the photogenerating layer.

For an ideal photoconductor, V(2.8 ergs/cm$^2$) should remain unchanged whether the photoconductor is exposed to light or not; usually the V(2.8 ergs/cm$^2$) drops after light exposure. A light shock resistant photoconductor exhibits less drop in V(2.8 ergs/cm$^2$), that is 37V (volts) for the Example I photoconductor versus 63V (volts) for the Comparative Example 1 photoconductor. Ideally, close to 0V (volt) drop is better.

Light shock usually causes dark bands in prints from the light exposed photoconductor area at t=0. A light shock resistant photoconductor usually will not print dark bands even when the photoconductor is exposed to light.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a supporting substrate, a photogenerating layer, and at least one charge transport layer comprised of at least one charge transport component, and wherein said photogenerating layer contains at least one charge trapping releaser component comprised of pyridinium trifluoroacetate, ammonium trifluoroacetate, tetraethylammonium trifluoroacetate, triethylamine trifluoroacetate, 4-dimethylamino-1-trifluoroacetylpyridinium trifluoroacetate, Rhodamine 6G-N-(2-aminoethyl)amide bis(trifluoroacetate), Rhodamine 6G-N-(6-aminohexyl)amide bis(trifluoroacetate), imidazole trifluoroacetate, N-methylaniline trifluoroacetate, diethylthallium trifluoroacetate, 2,6-bis-(4-methoxy-phenyl)-4-phenyl-pyranylium trifluoroacetate, tetraethylphosphonium trifluoroacetate, 4-isopropyl-4'-methyldiphenyliodonium trifluoroacetate, tri-p-tolylsulfonium trifluoroacetate, or 2,3,5-triphenyltetrazolium trifluoroacetate each present in an amount of from about 0.1 to about 20 weight percent.

2. A photoconductor in accordance with claim 1 wherein said releaser is formed by an acid-base neutralization reaction wherein the acid is a haloacetic acid; the base is at least one of ammonia, an amine, a pyridine, an aniline, and an imidazole; and the mole ratio of the acid and the base is about 1:1.

3. A photoconductor in accordance with claim 2 wherein said haloacetic acid is selected from the group consisting of monofluoroacetic acid, monochioroacetic acid, monobromoacetic acid, monoiodoacetic acid, dichioroacetic acid, trichloroacetic acid, trifluoroacetic acid, and mixtures thereof.

4. A photoconductor in accordance with claim 1 wherein said releaser is present in an amount of from about 0.1 to about 10 weight percent.

5. A photoconductor in accordance with claim 1 wherein said releaser is present in an amount of from about 1 to about 10 weight percent.

6. A photoconductor in accordance with claim 1 wherein said releaser is present in an amount of from about 2 to about 5 weight percent.

7. A photoconductor comprising a supporting substrate, a photogenerating layer, and at least one charge transport layer comprised of at least one charge transport component, and wherein said photogenerating layer contains at least one charge trapping releaser component, and wherein said releaser is pyridinium trifluoroacetate, ammonium trifluoroacetate, imidazole trifluoroacetate, diethylthallium trifluoroacetate, or 2,6-bis-(4-methoxy-phenyl)-4-phenyl-pyranylium trifluoroacetate present in an amount of from about 0.5 to about 7 weight percent.

8. A photoconductor in accordance with claim 1 wherein said charge transport component is comprised of at least one of aryl amine molecules

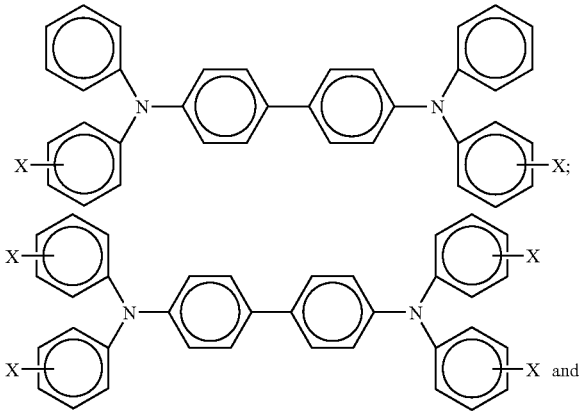

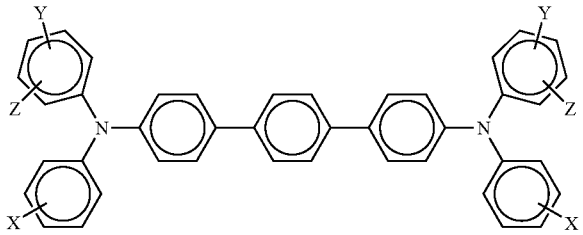

wherein X is selected from the group consisting of at least one of alkyl, alkoxy, aryl, and halogen; and wherein X, Y and Z are independently selected from the group consisting of at least one of alkyl, alkoxy, aryl, and halogen.

9. A photoconductor in accordance with claim 1 wherein said charge transport component is an aryl amine selected from the group consisting of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, diphenyl-N,N'-bis(3-chlorophenyl)-[p-terphenyl]-4,4"-diamine, and mixtures thereof, and wherein said at least one charge transport layer is from 1 to about 4.

10. A photoconductor in accordance with claim 1 further including in at least one of said charge transport layers an antioxidant comprised of at least one of a hindered phenolic and a hindered amine, and wherein said at least one charge transport layer is from 1 to 2.

11. A photoconductor in accordance with claim 1 wherein said photogenerating layer is comprised of at least one photogenerating pigment.

12. A photoconductor in accordance with claim 11 wherein said photogenerating pigment is comprised of at least one of a metal phthalocyanine, a perylene, and a metal free phthalocyanine.

13. A photoconductor in accordance with claim 1 further including a hole blocking layer, and an adhesive layer.

14. A photoconductor in accordance with claim 1 wherein said at least one charge transport layer is comprised of a first and a second charge transport layer, and wherein said releaser is included in said photogenerating layer in an amount of from about 0.5 to about 10 weight percent based on the photogenerating layer components, and wherein the total amount of said photogenerating components is about 100 percent.

15. A photoconductor in accordance with claim 1 wherein said at least one charge transport layer is from 1 to about 3 layers.

16. A photoconductor comprised in sequence of an optional supporting substrate, a photogenerating layer, and a charge transport layer; and wherein said photogenerating layer contains pyridinium trifluoroacetate (pyridine trifluoroacetate), ammonium trifluoroacetate, tetraethylammonium trifluoroacetate, triethylamine trifluoroacetate, 4-dimethylamino-1-trifluoroacetylpyridinium trifluoroacetate, Rhodamine 6G-N-(2-aminoethyl)amide bis(trifluoroacetate), Rhodamine 6G-N-(6-aminohexyl)amide bis(trifluoroacetate), imidazole trifluoroacetate, N-methylaniline trifluoroacetate, diethylthallium trifluoroacetate, 2,6-bis-(4-methoxy-phenyl)-4-phenyl-pyranylium trifluoroacetate, tetraethylphosphonium trifluoroacetate, 4-isopropyl-4'-methyldiphenyliodonium trifluoroacetate, tri-p-tolylsulfonium trifluoroacetate, or 2,3,5-triphenyltetrazolium trifluoroacetate present in an amount of from about 0.05 to about 15 weight percent.

17. A photoconductor comprising a supporting substrate, a photogenerating layer, a first hole transport layer, and a second hole transport layer; and wherein said photogenerating layer has incorporated therein ammonium trifluoroacetate, tetraethylammonium trifluoroacetate, triethylamine trifluoroacetate, 4-dimethylamino-1 -trifluoroacetylpyridinium trifluoroacetate, Rhodamine 6G-N-2-aminoethyl)amide bis(trifluoroacetate), Rhodamine 6G-N-(6-aminohexyl)amide bis (trifluoroacetate), imidazole trifluoroacetate, N-methylaniline trifluoroacetate, diethylthallium trifluoroacetate, 2,6-bis-(4-methoxy-phenyl)-4-phenyl-pyranylium trifluoroacetate, tetraethylphosphonium trifluoroacetate, 4-isopropyl-4'-methyldiphenyliodonium trifluoroacetate, tri-p-tolylsulfonium trifluoroacetate, or 2,3,5-triphenyltetrazolium trifluoroacetate present in an amount of from about 0.1 to about 20 weight percent.

18. A photoconductor in accordance with claim 17 wherein said photogenerating layer includes a photogenerating pigment of a hydroxygallium phthalocyanine, a titanyl phthalocyanine, or a halogallium phthalocyanine.

19. A photoconductor in accordance with claim 17 wherein said photogenerating layer has incorporated therein pyridinium trifluoroacetate.

* * * * *